United States Patent [19]

Tax et al.

[11] 4,376,452

[45] Mar. 15, 1983

[54] SYSTEM FOR LOADING LIQUIDS

[75] Inventors: Hans Tax, Potsdamer Strasse 3, D-8000 Munich 40, Fed. Rep. of Germany; Klaus Hösler, Eichenau, Fed. Rep. of Germany

[73] Assignee: Hans Tax, Munich, Fed. Rep. of Germany

[21] Appl. No.: 205,288

[22] Filed: Nov. 8, 1980

[30] Foreign Application Priority Data

Nov. 13, 1979 [DE] Fed. Rep. of Germany ..... 2945768

[51] Int. Cl.[3] ..... B67D 5/00

[52] U.S. Cl. ..... 137/615; 141/387; 254/277; 254/337

[58] Field of Search ..... 137/615, 236 R; 141/387, 388, 279, 284; 254/277, 336, 337, 392, 399

[56] References Cited

U.S. PATENT DOCUMENTS

| | | | |
|---|---|---|---|
| 1,680,831 | 8/1928 | White | 137/615 |
| 4,090,538 | 5/1978 | Kotchurian | 141/387 X |
| 4,092,996 | 6/1978 | Kock | 137/615 X |
| 4,121,616 | 10/1978 | Lochte et al. | 137/615 |
| 4,126,298 | 11/1978 | Lub | 254/277 |
| 4,202,372 | 5/1980 | Gibbons | 137/615 |
| 4,220,177 | 9/1980 | Gill | 141/387 X |
| 4,261,398 | 4/1981 | Haley | 141/387 |
| 4,272,059 | 6/1981 | Noerager et al. | 254/392 |

FOREIGN PATENT DOCUMENTS 2367700 10/1976 France .

*Primary Examiner*—A. Michael Chambers

*Attorney, Agent, or Firm*—Toren, McGeady and Stanger

[57] ABSTRACT

A system for loading liquids, particularly useful with water-borne oil tankers, which is basically constructed of liquid conduits articulated in the form of lazy tongs and vertically suspended from a cantilevered boom to enable oil to be loaded from a drilling platform onto a vessel. The lazy tongs system is formed with at least two vertically displaced articulated joints to enable the lower end of the system to move vertically for attachment to or during loading of a vessel. A block and tackle is provided for vertical actuation of the lazy tongs system.

20 Claims, 5 Drawing Figures

SYSTEM FOR LOADING LIQUIDS

The present invention relates to a loading system particularly useful in connection with liquid loads such as oil, and especially adapted for loading oil from a drilling platform onto a floating tanker.

The invention relates to a system of the type comprising liquid conduits articulated in the form of lazy tongs and suspended from a beam to be adjustable in the vertical direction. A lowermost articulated joint of the lazy tongs system is suspended to be vertically adjustable by a block and tackle.

In a known loading system of the type to which the present invention relates, a rope hoisting system involving only a single rope is utilized to engage the bottom articulated joint of the lazy tongs. This hoisting rope system carries the load of its own weight as well as the load of the lazy tongs system. Very large and heavy lazy tongs systems, as are used for example for loading ships from drilling platforms, usually involve rather large moments and stresses which may be applied at the arms of the lazy tongs system. These moments lead to bending stresses on the arms and, in order to prevent the risk of a rupture, particularly at low temperatures which may be necessary for handling loads such as liquid gas, the lazy tongs system must be structured of adequate strength. This requirement further increases the weight of the lazy tongs system and affects its maneuverability.

Accordingly, it is an object of the present invention to provide a loading system of the type described wherein the lazy tongs assembly of the system may be relieved of moments or stresses produced as a result of its own weight and due to the weight of the load contained therein.

SUMMARY OF THE INVENTION

Briefly, the present invention may be defined as a loading system, particularly for liquid loads, comprising a system of liquid flow conduits articulated in the form of lazy tongs and including at least a lower articulated joint and one additional articulated joint thereabove, the lazy tongs system being suspended from a beam and adjustable therefrom in the vertical direction. The lazy tongs system is actuated by a hoisting rope system or block and tackle operatively connected with each of the lower articulated joint and additional articulated joint of the lazy tongs system. The hoisting rope system or block and tackle is tuned or cooperatively related with regard to its adjusting speed to the speed ratio of the articulated joints resulting from the geometry of the lazy tongs arrangement.

In order to enable horizontal compensating and/or adaptive movements with suspension of the lazy tongs system on a beam carriage capable of moving along a track of the horizontally extending beam and in order to provide arrangement of the drive of the hoisting rope systems outside of the beam carriage without altering the vertical adjustment of the lazy tongs system. It is provided in accordance with another feature of the invention that the ropes or cables of the hoisting rope systems be guided along the track and over rope guide rollers or blocks of the beam carriage in such a manner that movement along the track will have no effect on the vertical positioning of the articulated joints of the lazy tongs system connected with the hoisting rope system relative to the beam carriage.

The invention also is concerned with the problem of arranging the roller blocks with Cardanic suspension of the lazy tongs on the beam of the system from where the hoisting rope strands of the hoisting rope system extend downwardly to the articulated joints of the lazy tongs system, utilizing the space conditions provided by the suspension joints of the lazy tongs system and to make sure that the Cardanic pivotal movements of the lazy tongs are hindered as little as possible by the hoisting rope system in order to lead to minimum deformation of the lazy tongs system in its principal plane.

In this regard, the invention is constructed as a loading system wherein the two uppermost arms or conduits of the lazy tongs system, which are arranged on opposite sides of a principal plane of the system, are each articulated with one joining knee by first pipe joints with articulated axles extending coaxially to each other and perpendicularly to the principal plane of the system in the intermediate joint plane of the tongs to one end of connecting knees, with these connecting knees being connected to connecting pipes by second pipe joints with articulated axles extending in the principal plane coaxially to each other and perpendicular to the intermediate joint plane of the tongs. Beginning from such a loading system, it is suggested, in order to accomplish the aforementioned requirements, to arrange one roller block each for the hoisting rope systems, seen in the vertically suspended position of the lazy tongs system, in quadrants wherein no uppermost arms or conduits are contained, which oppose each other regarding the intersection of the principal plane and of the intermediate joint plane of the lazy tongs system and which are defined by these planes, whereby the roller blocks are pivotally mounted by pivot bearings on the beam of the lazy tongs system whose pivots, seen in the vertically suspended position of the lazy tongs, are substantially perpendicular to the principal plane and whose roller axles are substantially perpendicular to the intermediate joint plane, again seen in the vertical suspended position of the lazy tongs.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
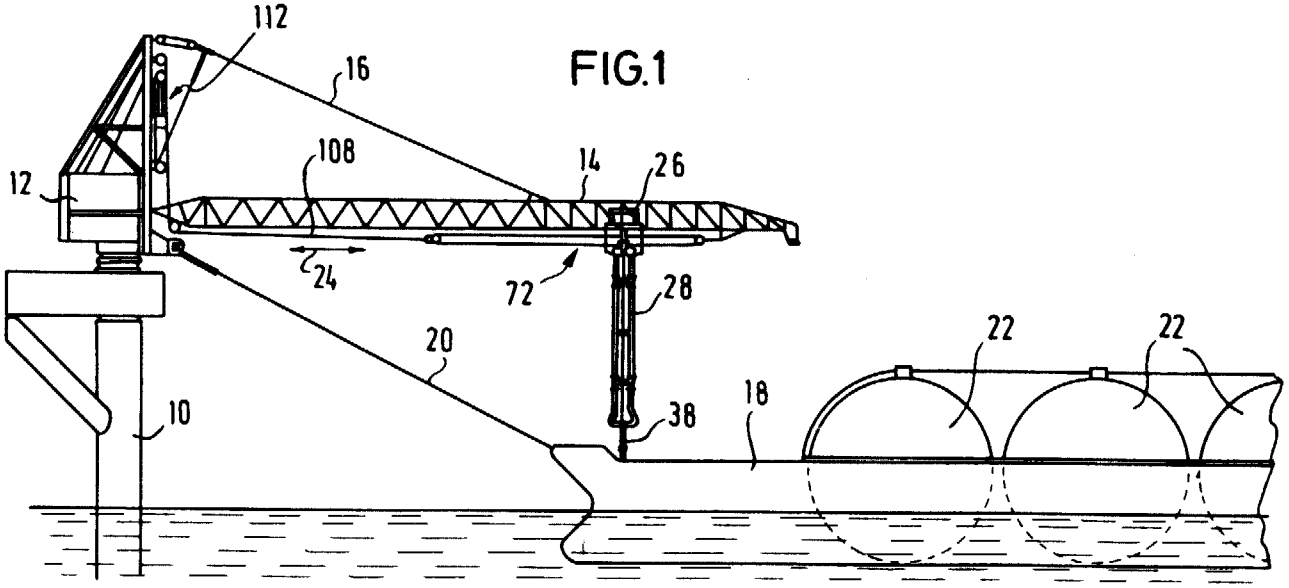
FIG. 1 is a schematic elevation showing a drilling platform having a loading crane for loading liquids from the platform onto a connected tanker.

Referring now to the drawings wherein similar parts are identified with like reference numerals throughout the various figures thereof, there is shown in FIG. 1 a drilling facility wherein the present invention may be used. The facility depicted in FIG. 1 essentially involves a drilling platform 10 from which oil or gas is to be loaded onto a vessel or loading ship 18. Arranged upon the drilling platform 10 is a loading crane 12 which is mounted for rotative motion about a vertical axis. The loading crane includes a crane boom 14 which is cantilevered outwardly from the drilling platform 10 and which is held in a substantially horizontal position by means of a guy cable 16.

The loading ship 18 is moored adjacent the drilling platform 10 and it is held in a desired position relative to the vertical swivel axis of the loading crane 12 by means of a mooring cable 20.

The loading ship 18 is equipped with tanks 22 which may be liquid storage tanks adapted to receive therein oil delivered from the drilling platform 10 or the tanks may be of the type adapted to receive liquefied gas.

Upon the boom 14 there is mounted a beam carriage 26 which is adapted for longitudinal movement along a track 24 in directions indicated by the double arrow. Mounted upon the beam carriage 26 and suspended vertically therefrom is an adjustable conduit system 28 which is shown in greater detail in FIG. 2.

Figure 2:
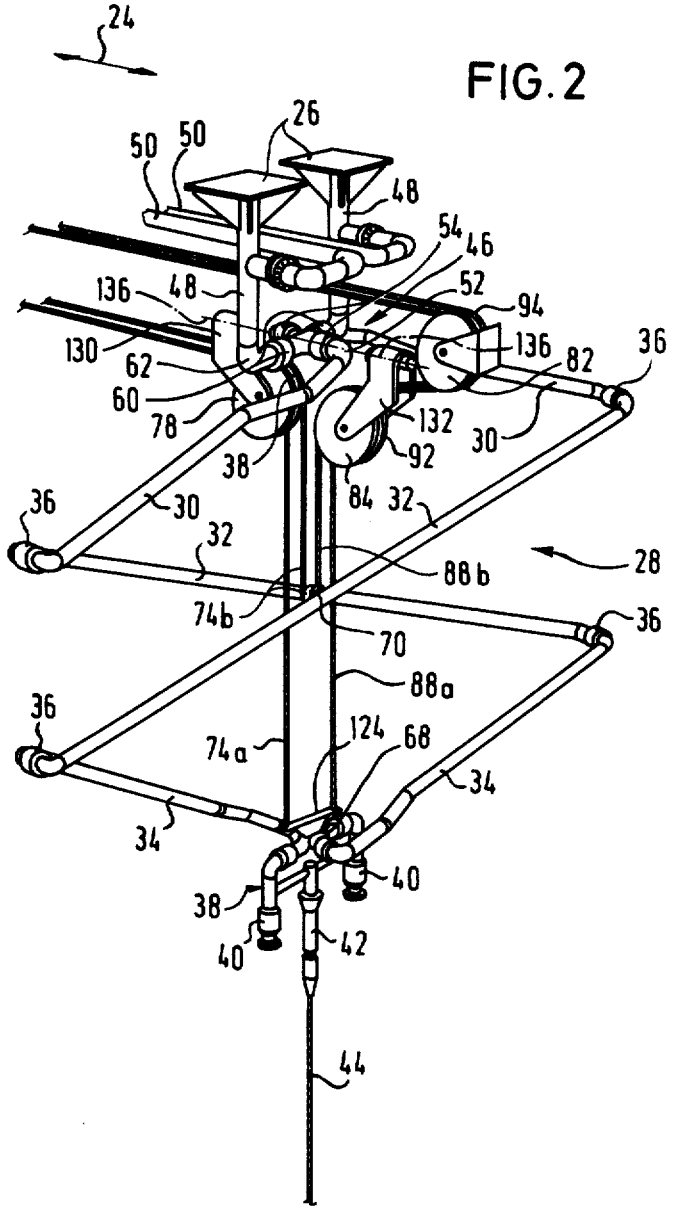
FIG. 2 is a schematic perspective view showing the vertically adjustable line system of the invention arranged in the form of lazy tongs and suspended from a loading crane.

The vertically adjustable conduit system in accordance with the present invention shown in FIG. 2 is essentially constructed in the form of a lazy tongs system. The lazy tongs system consists essentially of a pair of upper half arms 30, a pair of central full arms 32, and a pair of bottom half arms 34. The arms 30 and 34 and the arms 32 are linked together by articulated joint couplings 36. Upon the bottom arms 34 there is suspended by means of a universal coupling a connecting head 38 for coupling the conduit system with the loading ship 18. The connecting head 38 comprises coupling sockets 40 for connection to corresponding sockets 41 on the ship, a centering member 42 for engagement of a centering member receiver 43 on the ship, and a pull-in rope 44 which serves to enable the connecting head 38 to be pulled toward the loading ship 18. The upper arms 30 are connected by a joint system 46 to coupling pipes 48 which are, in turn, fixed on the beam carriage 26. The coupling pipes 28 are connected by connecting pipes 50 with a liquid supply on the loading crane 12 and sliding couplings may be arranged in the connecting pipes 50 which permit longitudinal movement of the beam carriage 26 along the track 24.

Figure 4:
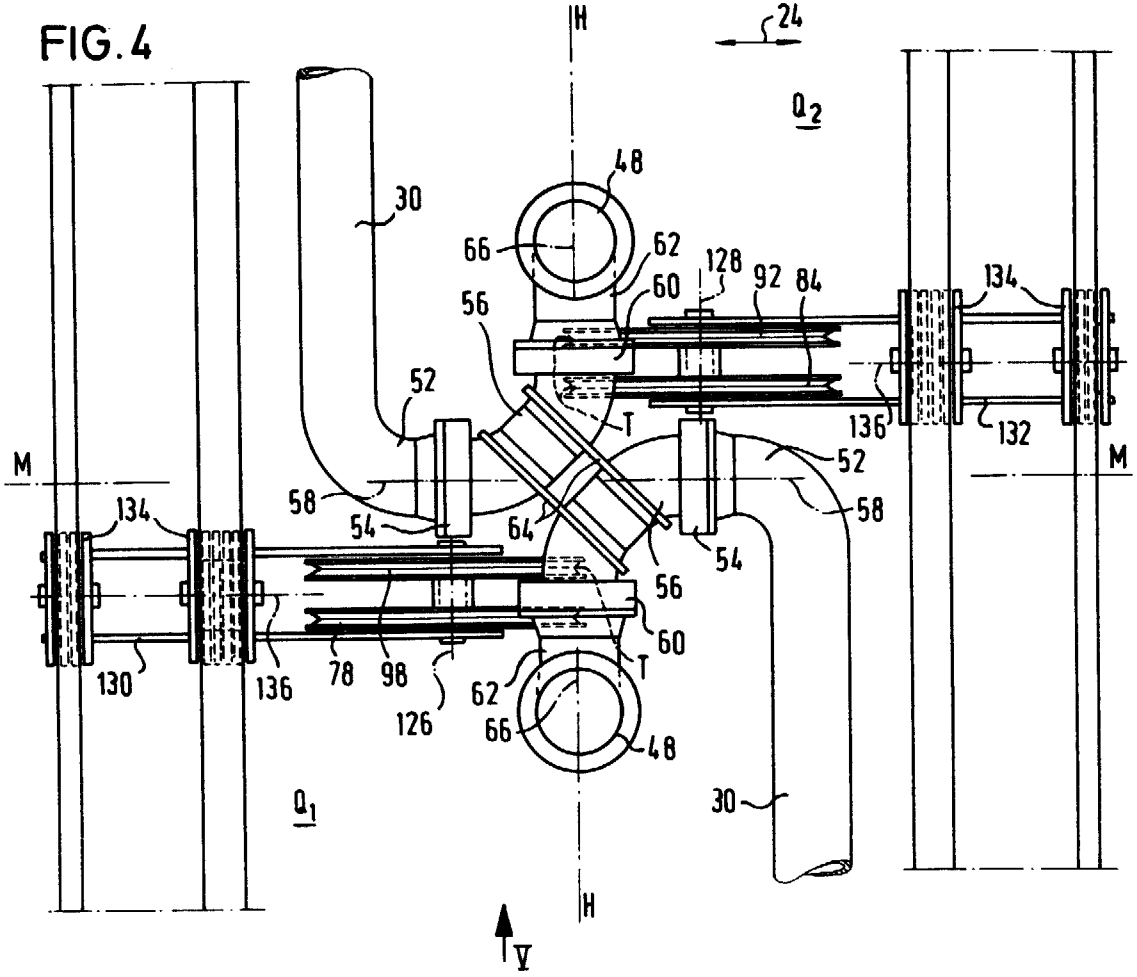
FIG. 4 is a top view of the system showing the uppermost conduits or upper half arms of the lazy tongs system with an arrangement of roller blocks from which hoisting ropes extend to the intermediate or articulated joints of the lazy tongs system.
Figure 5:
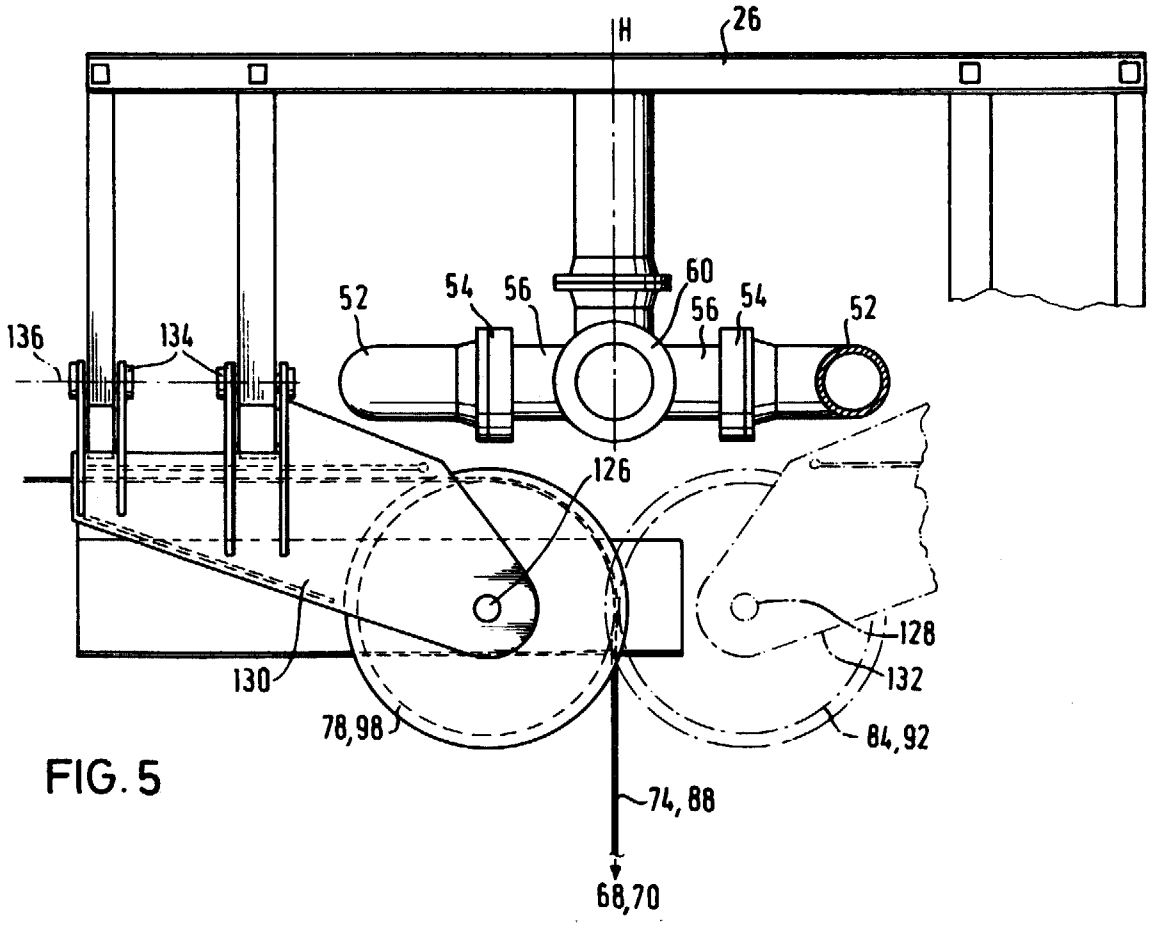
FIG. 5 is a partial side elevation taken in the direction of the arrow V shown in FIG. 4.

The design of the joint system 46 is shown in greater detail in FIGS. 4 and 5.

As seen in FIGS. 4 and 5, the two upper arms 30 are laterally staggered in both directions relative to a principal plane H of the device which extends in directions perpendicular to the directions of movement of the track 24 represented by the double arrow. The arms 30 are secured at their upper ends by means of 90° elbows through pipe joints 54 to 90° connecting knees or elbows 56. The articulated axles of the first pipe joints 54 are designated 58. The axles or axes 58 are substantially perpendicular to the principal plane H in the vertical suspended position of the lazy tongs system shown in FIG. 4. The connecting elbows 56 are joined with their other ends by means of second pipe joints 60 to 90° elbows 62 which, in turn, extend into the joining pipes 48. The connecting knees 56 are mechanically joined together, for example by substantially rigid coupling elements 64.

The arms 30 and 34 and the arms 32 are formed by self-supporting pipes or conduits through which liquid to be loaded may flow from the connecting pipes 50 to the loading ship 18. It should be noted that the articulated axles 66 of the second pipe joints, seen in the vertical suspended position of the lazy tongs system, will extend in the principal plane H perpendicular to an intermediate joint plane M of the lazy tongs system, which plane M extends perpendicularly to the principal plane H.

The lazy tongs system has a lower intermediate or articulated joint 68 in the range of the joining head 38 and a central intermediate or articulated joint 70 at the intersection of the arms 32. The axes of the intermediate joints 68 and 70 are perpendicular to the principal plane H and they define the intermediate joint plane M by virtue of the fact that their axes lie within the plane M.

The lazy tongs system is deformable in its principal plane and the deformation of the lazy tongs system in the principal plane yields the vertical variations of the line system section 28. Furthermore, the lazy tongs system can swivel about the joint axles 58 of the first pipe joints 54. Finally, the lazy tongs system can also swivel perpendicularly to its principal plane about axes 66 of the second pipe joints 6. Due to the deformability of the lazy tongs system, there will occur what may be called short-time and long-time vertical fluctuations of the loading ship 18 relative to the boom 14 which can be controlled. Short-time fluctuations are intended as those which are caused by tides or by changes in the loading state or condition of the ship.

Connecting pipes 50 and adjoining pipe portions of the lazy tongs system may be arranged parallel to each other. However, when liquefied gas is to be loaded, the liquefied gas can be delivered to the loading ship 18 through one connecting pipe, while the evaporated gas may be returned through another pipe.

For deformation of the lazy tongs system, adapted to such fluctuations as those defined above, there is provided a hoisting rope arrangement which is generally designated with the reference numeral 72 in FIG. 1. The hoisting rope arrangement is shown in greater detail in FIG. 3. A first hoisting rope 74 extends from one end point 76 on the bottom intermediate joint 68 over a first guide roller 78 on the beam carriage 26, over a compensating roller 80, over a guide roller 82 fixed on the track 24, and over a second guide roller 84 on beam carriage 26 to a fixed point 86 on the central intermediate joint 70.

A second hoisting rope 88 extends from one end point 90 on the bottom intermediate joint 68 over a first guide roller 92 on the beam carriage 26, over a guide roller 94 fixed on the track 24, over a compensating roller 96, and over a second guide roller 98 on the beam carriage 26 to a fixed point 100 on the central intermediate joint 70.

Compensating rollers 80 and 96 are arranged on a compensating roller support 102 which can be adjusted parallel to the track 24 by means of a slide 104. A balance beam 106, which may be adjusted through a driving rope system 108 in the longitudinal direction of the track, acts upon the compensating roller support 102. The driving rope system 108 comprises two parallel drive ropes 110 which extend over a tensioning system 112 to a rope drum 114. The rope drum 114 is driven by a driving motor 116 and the tensioning system 112 comprises a hydropneumatic spring 118 with roller blocks 120/122 arranged at its ends which may be adjusted relative to each other.

Figure 3:
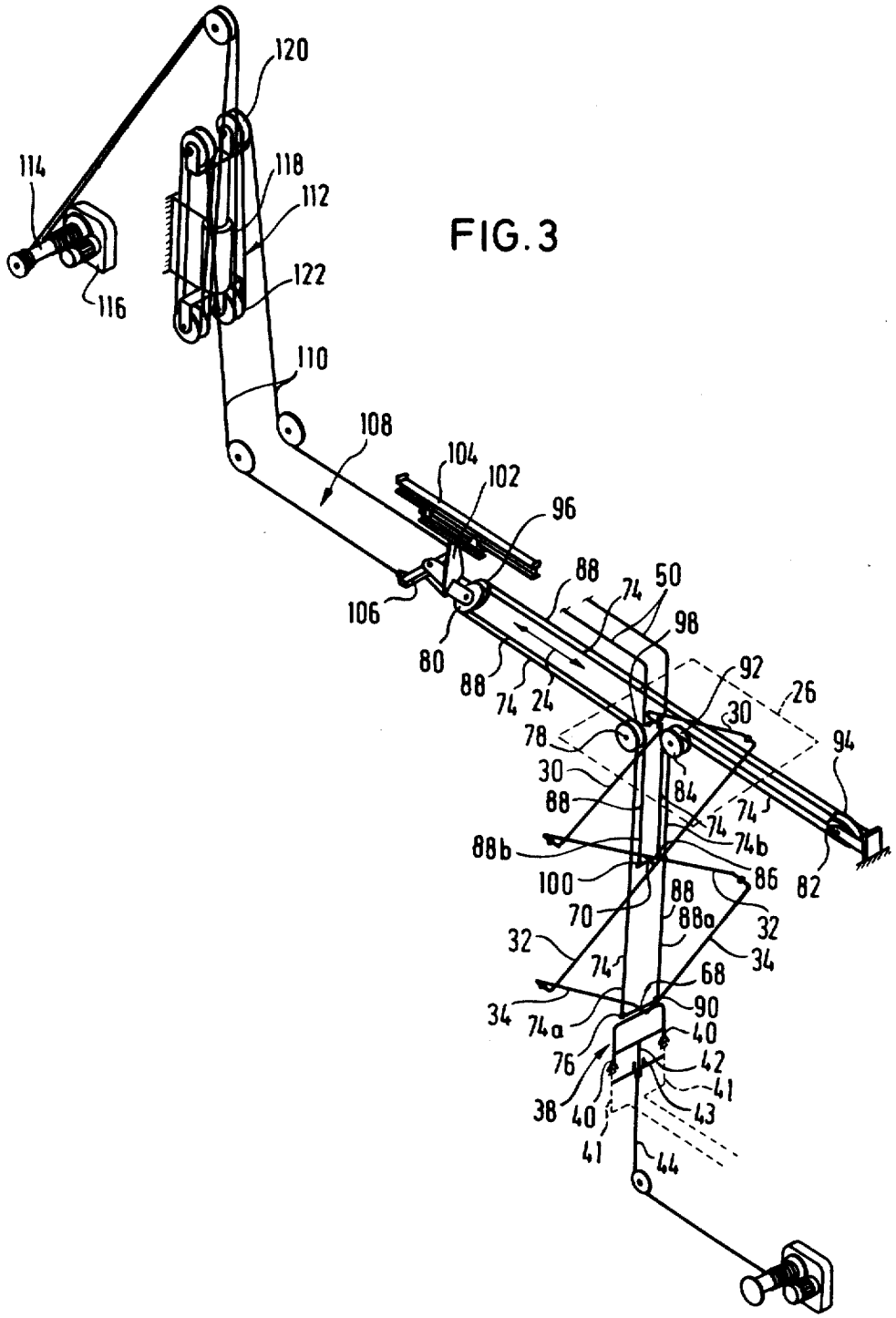
FIG. 3 is a perspective view showing the block and tackle or hoisting rope system adaptable to effect vertical adjustment of the lazy tongs system shown in greater detail in FIG. 2.

By actuation of the rope drum 114, the balance beam 106 shown in FIG. 3 may be displaced to the left and by releasing the rope drum 114, the balance beam 106 may be displaced to the right in the direction of the track 24. In displacement of the balance beam 106, hoisting ropes 74, 88 will be influenced through compensating rollers 80, 96 in the sense of raising or lowering the intermediate joints 68, 70. The compensation of the ropes adapted to the different displacements of the intermediate joints caused by the geometry of the lazy tongs system 28 is automatically effected over the rollers 78, 80, 82, 84 and 92, 94, 96, 98, respectively.

Generally speaking, the rope ends **74*a*, 88*a* acting upon the bottom intermediate joint 68 may be considered as a first hoisting rope system for the displacement of the bottom intermediate joint 68. The rope ends 74*b*, 88*b* acting on the central intermediate joint 70 may be considered as a hoisting rope system for the displacement of the central intermediate joint 70**.

The tensioner 112 serves to maintain the hoisting ropes under tension at the joining head 38 coupled with the loading ship 18 even in the case where there occur short-time and long-time fluctuations in the vertical positioning between the loading ship 18 and the boom 14.

With the joining head 38 uncoupled, the tensioner 112 is extended to its full length. As soon as the joining head 38 is maneuvered without a connection to loading ship 18, the displacement of the rope arrangement 72 is effected exclusively over hoisting rope drum 114. When the joining head 38 has reached, during a joining maneuver, a certain height above the loading ship 18, the rope drum 114 may be locked and further approach of the joining head 38 will be effected by means of the pull-in rope 44 whereby there will occur deformation of the tensioner 112. Care should be taken that, after the end position of the joining head on the loading ship has been reached, the tensioner 112 is set to the center position of its entire displacement path, assuming a normal position of the ship relative to the boom 14. When vertical fluctuations appear in one direction or the other, they may be compensated by the tensioner 112.

Due to the fact that a second hoisting rope system, generally comprised of the rope ends **74*b*, 88*b* is provided which acts upon the central intermediate joint 70, in addition to the hoisting rope systems 74*a*, 88*a*, acting on the bottom intermediate joint 68, the arms 30, 32, 34 of the lazy tongs system 28** will be relieved of stresses which would otherwise be caused by the weight of the arms themselves or by the material with which the arms or conduits may be filled.

As will be seen from FIG. 2, the hoisting ropes 74 and 88, seen in the vertical suspended position of the lazy tongs, extend parallel to each other substantially in the vertical direction. The points of action of the hoisting ropes 74, 88 are, as can be seen on the bottom intermediate joint 68, provided on arms 124 which may be designed as balance beams.

FIGS. 4 and 5 show the arrangement of the roller blocks 78, 98 on the one hand, and 84, 92 on the other hand, relative to the arms 30 and the pipe joints 52, 60. It will be seen that the roller blocks 78, 98 are arranged in a quadrant $Q_1$ which is defined between the principal plane H and the intermediate joint plane M. The roller blocks 84, 92 are arranged in a quadrant $Q_2$ which is likewise defined between the principal plane H and the intermediate joint plane M, the quadrants $Q_1$, $Q_2$ opposing each other with regard to the intersection of these planes. That is, it will be seen that the quadrant $Q_1$ and the quadrant $Q_2$ are arranged diagonally juxtaposed, as seen in FIG. 4.

As will also be seen from FIG. 4, the roller axis 126 of roller block 78, 98 and the roller axis 128 of the roller block 84, 92 are perpendicular to the intermediate joint plane M seen in the vertical suspended position of the lazy tongs system 28. Roller blocks 78, 98 and 84, 92 are so arranged relative to the principal plane H that the vertical rope run-off tangents of the hoisting ropes 74, 88 leading to the intermediate joints 68, 70 extend substantially in the principal plane H. That is, as will be seen from FIG. 3, the rope ends **74*a*, 88*a* and 74*b*, 88*b* each extend tangentially to the rollers 78, 92**, respectively, vertically downwardly and lie within the principal plane H.

As will be seen from FIG. 5, the roller blocks 78, 98 and 84, 92 are mounted in roller block supports 130, 132 which, in turn, are pivotally mounted in pivot bearings 134 attached on the beam carriage 26. The pivot axes of the pivot bearings 134 are designated 136. The pivot bearings 134 with their pivot axes 136 may also be seen in FIG. 4.

As will be seen in FIG. 5, the roller blocks 78, 98 and 84, 92 are arranged beneath the pipe joints 54 and 60 but at a very small vertical distance from the latter.

The arrangement and mounting of the roller blocks 78, 98 and 84, 92, shown in FIGS. 2, 4, and 5, is important primarily in order to enable the roller blocks to be accommodated in the vicinity of the intersection between the planes M and H and in order to arrange the ropes so that they will extend from the beam carriage 26 to the joints 68 and 70 concentrically or symmetrically with regard to the intersection of the planes M and H. On the other hand, the arrangement of the roller blocks 78, 98 and 84, 92 in the position described and represented has been so selected that the rope ends **74*a* and 88*a* and 74*b* and 88*b* extending off the rollers will not hinder the Cardanic suspension of the lazy tongs system by means of the pipe joints 54 and 60**, or at least will effect as little interference as possible.

The rotation of the lazy tongs system in its principal plane may best be perceived on the basis of FIG. 2; that is, in the pipe joints 54, hoisting rope ends **74*a*, 88*a* and 74*b*, 88*b* may follow this movement because the roller blocks 78, 98 and 84, 92 may turn with their roller block supports 130, 132 on the pivot axes 136. It will also be seen from FIG. 2 that the hoisting rope ends 74*a*, 88*a* and 74*b*, 88*b* can follow a swivel movement of the lazy tongs system in the pipe joints 60 because the tangential run-off of the rope ends are then displaced on the rollers 78, 98 and 84, 92** in the respective roller plane.

Thus, without regard to the hoisting ropes, this will ensure that the lazy tongs system can move in the pipe joints 54 and 60 relative to a vertical suspended position of the lazy tongs and be able to compensate in this manner minor horizontal displacements of the loading ship 18 relative to the beam carriage 26, both in the longitudinal direction of the boom 14 and perpendicularly to its longitudinal direction.

The beam carriage 26 may also move in the longitudinal direction of the track 24 by virtue of the reeving of the hoisting ropes 74, 88 depicted in FIG. 3, without change in the height of the intermediate joints 68, 70 relative to the track 24 with a constant position of compensating rollers 80, 96. This is due to the fact that in the movement of the beam carriage, as depicted in FIG. 3, to the left, the rope lengths then released between the rollers 78, 98 and the rollers 80, 96 will be taken up between the rollers 84 and 92 and rollers 82 and 94. In this way, it is possible to compensate longer horizontal paths between the drilling platform and the loading ship 18 by moving the beam carriage in the direction of the boom 14.

While a specific embodiment of the invention has been shown and described in detail to illustrate the application of the inventive principles, it will be understood that the invention may be embodied otherwise without departing from such principles.

What is claimed is:

1. A loading system for liquid loads comprising: a system of liquid flow conduits articulated in the form of lazy tongs and including a lower intermediate joint and at least one additional intermediate joint thereabove; a beam having said lazy tongs system suspended therefrom for adjustable movement in the vertical direction; a first hoisting rope system having said lower intermediate joint suspended therefrom for effecting vertical adjustment thereof; and an additional hoisting rope system having said additional intermediate joint suspended therefrom for effecting vertical adjustment thereof; said hoisting rope systems being cooperatively related with regard to their adjusting speed corresponding to the speed of said intermediate joints effected by the geometry of said lazy tongs system; with at least one hoisting rope connected to a hoisting rope drive being common to both said hoisting rope systems; said lazy tongs system being suspended from said beam on a beam carriage movable along a track provided on said beam, wherein said hoisting rope drive is arranged outside of said beam carriage and wherein the rope lines of said hoisting rope systems are so guided along said track over guide rollers of said beam carriage that the beam carriage is movable along said track without influencing the vertical positions of said intermediate joints of said lazy tongs system relative to said beam carriage; said system including one hoisting rope which is coupled at one end with said lower intermediate joint and which extends over a first guide roller in said beam carriage, over a guide roller connected to said hoisting rope drive, over a guide roller secured on said track and over a second guide roller on said beam carriage to said additional intermediate joint of said lazy tongs system.

2. A loading system for liquid loads comprising: a system of liquid flow conduits articulated in the form of lazy tongs and including a lower intermediate joint and at least one additional intermediate joint thereabove; a beam having said lazy tongs system suspended therefrom for adjustable movement in the vertical direction; a first hoisting rope system having said lower intermediate joint suspended therefrom for effecting vertical adjustment thereof; and an additional hoisting rope system having said additional intermediate joint suspended therefrom for effecting vertical adjustment thereof; said hoisting rope systems being cooperatively related with regard to their adjusting speed corresponding to the speed of said intermediate joints effected by the geometry of said lazy tongs system; said lazy tongs system being arranged to define an intermediate joint plane having the pivot axes of said lower and additional intermediate joints lying therein and a principal plane extending perpendicularly to said intermediate joint plane, with said liquid flow conduits arranged as articulated arms of said lazy tongs system disposed on opposite sides of said principal plane and extending generally parallel thereto, said principal plane and said intermediate joint plane intersecting to form quadrants; wherein said lazy tongs system includes a pair of liquid flow conduits arranged as the uppermost arms of said lazy tongs system and having their uppermost ends articulated about joints which lie on opposite sides of said principal plane and which define coaxial pivot axes lying within said intermediate joint plane, said uppermost arms extending within one diagonally juxtaposed pair of said quadrants; and wherein said hoisting rope systems are arranged to extend vertically into engagement with said intermediate joints from a pair of roller blocks located in the other diagonally juxtaposed pair of said quadrants and arranged for rotation about roller axes extending substantially perpendicularly to said intermediate joint plane; said roller blocks being suspended from said beam by pivot bearings which are mounted for pivotal motion relative to said beam about pivot axes extending substantially perpendicular to said principal plane.

3. A loading system for liquid loads comprising: a system of liquid flow conduits articulated in the form of lazy tongs and including a lower intermediate joint and at least one additional intermediate joint thereabove; a beam having said lazy tongs system suspended therefrom for adjustable movement in the vertical direction; a first hoisting rope system having said lower intermediate joint suspended therefrom for effecting vertical adjustment thereof; an additional hoisting rope system having said additional intermediate joint suspended therefrom for effecting vertical adjustment thereof; and hoisting drive means, said hoisting rope systems being cooperatively related with regard to their adjusting speed corresponding to the speed of said intermediate joints effected by the geometry of said lazy tongs system; said first and second hoisting rope systems including a hoisting rope coupled at one end thereof with one of said intermediate joints, said hoisting rope extending over a first guide roller mounted on said beam, at least one compensating roller connected to said hoisting drive means, a second guide roller connected to said beam, a third guide roller connected to said beam to the other one of said intermediate joints, said first and said third guide rollers being at an intermediate position along said beam between said compensating roller and said second guide roller.

4. A loading system for liquid loads comprising: a system of liquid flow conduits articulated in the form of lazy tongs and including suspension joint means and at least one vertically movable intermediate joint; a beam having said lazy tongs system suspended therefrom for adjustable movement of said intermediate joint in the vertical direction; and a hoisting rope system having said intermediate joint suspended therefrom for effecting vertical adjustment thereof; said lazy tongs system being arranged to define an intermediate joint plane (MM) having the pivot axes of said suspension joint means and said intermediate joint lying therein and a principal plane extending perpendicularly to said intermediate joint plane, with said liquid flow conduits arranged as articulated arms of said lazy tongs system disposed on opposite sides of said principal plane and extending generally parallel thereto, said principal plane and said intermediate joint plane intersecting to form quadrants; said lazy tongs system including a pair of liquid flow conduits arranged as the uppermost arms of said lazy tongs system and having their uppermost ends articulated about suspension joints which lie on opposite sides of said principal plane and which define coaxial pivot axes lying within said intermediate joint plane, said uppermost arms extending within one diagonally juxtaposed pair of said quadrants; said hoisting rope system comprising first rope means and second rope means which are arranged to extend vertically into engagement with said intermediate joint from a pair of roller blocks located in the other diagonally juxtaposed pair of said quadrants and having at least one roller respectively arranged for rotation about a respective roller axis extending substantially perpendicularly to said intermediate joint plane; said roller blocks being suspended from said beam by pivot bearings which are mounted for pivotal motion relative to said beam about pivot axes extending substantially perpendicular to said principal plane.

5. A system according to claim 4 wherein said roller blocks are arranged relative to said principal plane so that the hoisting ropes of said hoisting rope system extend tangentially therefrom to said intermediate joint to lie substantially within said principal plane.

6. A system according to clain 5 wherein said roller blocks are arranged with their tangents from which said hoisting ropes extend laterally staggered relative to said intermediate joint plane.

7. A system according to claim 6 wherein said roller blocks are arranged beneath said suspension joints at said uppermost ends of said uppermost arms.

8. A system according to claim 4 wherein said pivot axes of said pivot bearings are arranged axially symmetrically relative to said suspension joints of said uppermost ends of said uppermost arms.

9. A system according to claim 4 wherein said uppermost ends of said uppermost arms of said lazy tongs system are joined at said suspension joints (54) with a pair of liquid infeed pipes (48) through a pair of elbow tubes (56), said elbow tubes (56) being connected to said infeed pipes (48) by respective elbow tube joints (60) having their pivot axes (66) substantially perpendicular to said intermediate joint plane (MM).

10. A system according to claim 4 wherein the rope strands of said rope means leading from said roller blocks to said intermediate joint act upon an arm of said intermediate joint in such a way that said rope strands seen in the vertical suspended position of said lazy tongs system likewise extend substantially in a vertical direction.

11. A loading system for liquid loads comprising: a system of liquid flow conduits having a plurality of articulated joints in the form of lazy tongs and including at least a lower intermediate articulated joint and one additional intermediate articulated joint thereabove; a beam having said lazy tongs system suspended therefrom for adjustable movement in the vertical direction; hoisting rope and pulley means including a first hoisting rope system having at least one end with said lower intermediate joint suspended therefrom for effecting vertical adjustment thereof and an additional hoisting rope system having at least one end with said additional intermediate joint suspended therefrom for effecting vertical adjustment thereof; said hoisting rope and pulley means being thereby connected to at least two of said plurality of articulated joints of said lazy tongs; said first and said second hoisting rope systems being cooperatively related with regard to their adjusting speed corresponding to the speed of said intermediate joints effected by the geometry of said lazy tongs system; with at least one hoisting rope being connected to a hoisting rope drive which is common to both said hoisting rope systems; said lazy tongs system being suspended from said beam on a beam carriage movable along a track provided on said beam, said hoisting rope drive being arranged outside of said beam carriage with the rope lines of said hoisting rope systems being so guided along said track over guide rollers of said beam carriage that the beam carriage is movable along said track without influencing the vertical positions of said intermediate joints of said lazy tongs system relative to said beam carriage; said system including one hoisting rope which is coupled at one end with said lower intermediate joint and which extends over a first guide roller in said beam carriage, over a guide roller connected to said hoisting rope drive, over a guide roller secured on said track and over a second guide roller on said beam carriage to said additional intermediate joint of said lazy tongs system.

12. A system according to claim 11 wherein a hoisting rope connected over a compensating roller to said drive is coupled at each end thereof with one each of said intermediate joints.

13. A system according to claim 11 wherein two hoisting ropes are provided, each being coupled at one end with said lower intermediate joint and at an opposite end with said additional intermediate joint.

14. A system according to claim 11 wherein said lazy tongs system is arranged to define an intermediate joint plane having the pivot axes of said lower and additional intermediate joints lying therein and a principal plane extending perpendicularly to said intermediate joint plane, with said liquid flow conduits arranged as articulated arms of said lazy tongs system disposed on opposite sides of said principal plane and extending generally parallel thereto, said principal plane and said intermediate joint plane intersecting to form quadrants; wherein said lazy tongs system includes a pair of liquid flow conduits arranged as the uppermost arms of said lazy tongs system and having their uppermost ends articulated about joints which lie on opposite sides of said principal plane and which define coaxial pivot axes lying within said intermediate joint plane, said uppermost arms extending within one diagonally juxtaposed pair of said quadrants; and wherein said hoisting rope systems are arranged to extend vertically into engagement with said intermediate joints from a pair of roller blocks located in the other diagonally juxtaposed pair of said quadrants and arranged for rotation about roller axes extending substantially perpendicularly to said intermediate joint plane; said roller blocks being suspended from said beam by pivot bearings which are mounted for pivotal motion relative to said beam about pivot axes extending substantially perpendicular to said principal plane.

15. A system according to claim 14 wherein said roller blocks are arranged relative to said principal plane so that the hoisting ropes of said hoisting rope systems extend tangentially therefrom to said intermediate joints to lie substantially within said principal plane.

16. A system according to claim 15 wherein said roller blocks are arranged with their tangents from which said hoisting ropes extend laterally staggered relative to said intermediate joint plane.

17. A system according to claim 16 wherein said roller blocks are arranged beneath said articulated joints at said uppermost ends of said uppermost arms.

18. A system according to claim 14 wherein said pivot axes of said pivot bearings are arranged axially symmetrically relative to said articulated joints of said uppermost ends of said uppermost arms.

19. A system according to claim 14 wherein said uppermost ends of said uppermost arms of said lazy tongs system are joined at said articulated joints with a pair of generally vertically extending liquid infeed pipes through a pair of elbow joints, with said elbow joints, said uppermost arms, and said roller blocks being laterally symmetrically arranged relative to a line defined by the intersection of said principal plane and said intermediate joint plane.

20. A system according to claim 14 wherein the rope strands of said hoisting rope systems leading from said roller blocks to said intermediate joints act upon arms of said intermediate joints in such a way that said rope strands seen in the vertical suspended position of said lazy tongs system likewise extend substantially in a vertical direction.

* * * * *